US008568102B2

(12) United States Patent
Menheere et al.

(10) Patent No.: US 8,568,102 B2
(45) **Date of Patent: *Oct. 29, 2013**

(54) FAN BLADE ANTI-FRETTING INSERT

(75) Inventors: David H. Menheere, Geogetown (CA); Quantai Liu, Mississauga (CA); Philip Ridyard, Mississauga (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 1260 days.

This patent is subject to a terminal disclaimer.

(21) Appl. No.: 12/372,755

(22) Filed: Feb. 18, 2009

(65) Prior Publication Data

US 2010/0209253 A1 Aug. 19, 2010

(51) Int. Cl.
*B63H 1/20* (2006.01)
*B63H 13/00* (2006.01)

(52) U.S. Cl.
USPC ..... 416/219 R; 416/248

(58) Field of Classification Search
USPC ..... 416/219 R, 248; 29/889
See application file for complete search history.

(56) References Cited

U.S. PATENT DOCUMENTS 3,294,364 A 12/1966 Stanley
3,712,757 A 1/1973 Goodwin
4,019,832 A * 4/1977 Salemme et al. ..... 416/135
4,621,979 A 11/1986 Zipps et al.
4,655,687 A 4/1987 Atkinson
5,049,035 A 9/1991 Marlin
5,160,243 A 11/1992 Herzner et al.
5,161,949 A 11/1992 Brioude et al.
5,240,375 A 8/1993 Wayte
5,368,444 A 11/1994 Anderson
5,791,877 A 8/1998 Stenneler
6,217,283 B1 4/2001 Ravenhall et al.
6,471,474 B1 10/2002 Mielke et al.
6,514,045 B1 2/2003 Barton et al.
6,837,686 B2 * 1/2005 Di Paola et al. ..... 416/220 R
7,153,099 B2 12/2006 Queriault et al.
2004/0013528 A1 1/2004 Leathart
2004/0126240 A1 7/2004 Bassot et al.
2008/0232969 A1 9/2008 Brault et al.
2010/0209251 A1 * 8/2010 Menheere et al. ..... 416/193 A

* cited by examiner

*Primary Examiner* — Nitin Parekh
(74) *Attorney, Agent, or Firm* — Norton Rose Fulbright Canada LLP

(57) ABSTRACT

A fan blade anti-fretting insert is described whereby to reduce wear between the root portion of a fan blade and the root slot of the rotor fan hub of a turbo fan engine to which the fan blade are secured. The anti-fretting insert can be formed of a composite spring material having a memory and is dimensioned and shaped to be fitted between the fan blade platform and the outer surface portion of the rotor fan hub between adjacent fan blades, whereby to apply a pushing force against the platform and consequently to the fan blades secure thereto thereby applying a resulting pulling force on the root portion of the fan blades to prevent rocking of the root portion in their root slots formed in the rotor fan hub.

7 Claims, 5 Drawing Sheets

FAN BLADE ANTI-FRETTING INSERT

TECHNICAL FIELD

The present disclosure relates to a fan blade anti-fretting insert to prevent wear of the root connections of the fan blades with the rotor fan hub of a turbo fan engine.

BACKGROUND ART

Attempts have been made to reduce wear in the root section of fan blades which are usually loosely fitted in respective blade slots formed in the rotor fan hub of turbofan engines. This wear occurs usually at low speeds (e.g. wind milling) wherein the root section experiences movement within the blade root slot. A current practice to prevent the fan blade root to rock in the fan hub slot, or limit blade movements, is to place inserts in the slots, under the blade root. However, this adds weight and reduces dovetail stiffness. When the fan is turned by wind action with the engine off, the fan blade does not cause sufficient centrifugal loading to stop the rocking of the fan blade root in the root slot resulting in fretting of the components thereby reducing the life of the parts.

SUMMARY

According to a general aspect, there is provided a fan blade anti-fretting arrangement to prevent wear between a root portion of a fan blade and a root slot of a rotor fan hub of a turbo fan engine, the anti-fretting arrangement comprising a U-shaped insert member formed of a composite spring material having a memory, said insert member defining a bottom wall portion abutting an outer surface portion of the rotor fan hub between adjacent fan blades and opposed side wall portions formed integral with said bottom wall portion, said side wall portions being dimensioned to abut at an upper end thereof against a platform connection of the adjacent fan blades, said insert member being dimensioned to exert a pushing force against the connection platform of the adjacent fan blades and a pulling force on the root portion to prevent rocking of the root portion in the root slot at low rotational speeds.

According to a still further broad general aspect, there is provided a method of preventing wear between a root portion of a fan blade and a root slot of a rotor fan hub of a turbofan engine, said method comprising the steps of: providing an insert member formed of composite spring material having a memory, said insert member having a bottom wall portion and opposed side wall portions; positioning said insert member in a gap formed between root portions of adjacent fan blades with said bottom wall portion abutting an outer surface portion of said rotor fan hub in said gap and said opposed wall portions abutting at an upper end thereof against a platform connection of said adjacent fan blades; applying a pushing force against said platform connection to result in a pulling force on said root portion to prevent rocking of said root portion in said root slot at low rotational speeds of said rotor fan hub.

BRIEF DESCRIPTION OF DRAWINGS

Reference is now made to the accompanying figures, in which.

DETAILED DESCRIPTION

Figure 1:
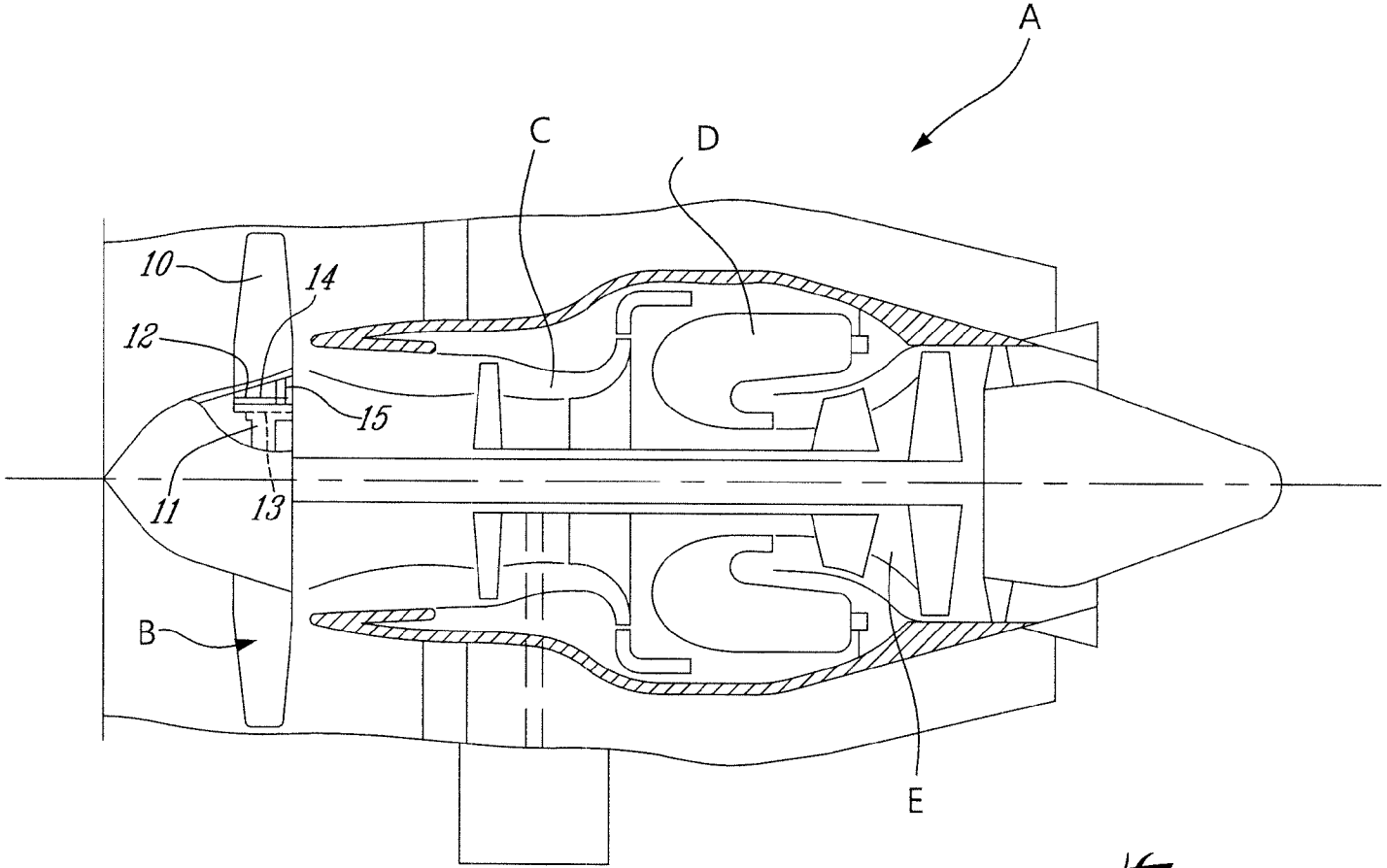
FIG. 1 is schematic cross sectional view of gas turbine engine partly fragmented to show the location of the fan blade anti-fretting and blade platform is insert of one embodiment of the present design.

FIG. 1 illustrates a turbo fan gas turbine engine A of a type preferably provided for use in subsonic flight, and generally comprising in serial flow communication a fan section B through which ambient air is propelled, a multistage compressor C for pressurizing the air, a combustor D in which the compressed air is mixed with fuel and ignited for generating an annular stream of hot combustion gases, and a turbine section E for extracting energy from the combustion gases.

As herein shown, the fan blade section B is comprised of a plurality of fan blades 10 secured about a rotor fan hub 11. Each fan blade 10 has a root section 12 depending from the undersurface of a fan blade platform 31 (see FIGS. 2, 3 and 4). The root section 12 of each blade 10 is retained in a root slot 13 formed in the 35 periphery of the rotor fan hub 11. As will be seen hereinafter, the size of the fan blade platforms 31 can be reduced and the space or resulting axial gap between each pair of adjacent reduced blade platforms 31 can be filled by a blade platform insert 14 including an integrated or separate anti-fretting support structure 15 adapted to apply a pulling force on the root section 12 of adjacent fan blades 10 to prevent rocking of the root sections 12 in the root slots 13 at low rotational speeds of the fan blades, such as when turned by wind action with the engine off.

Figure 2:
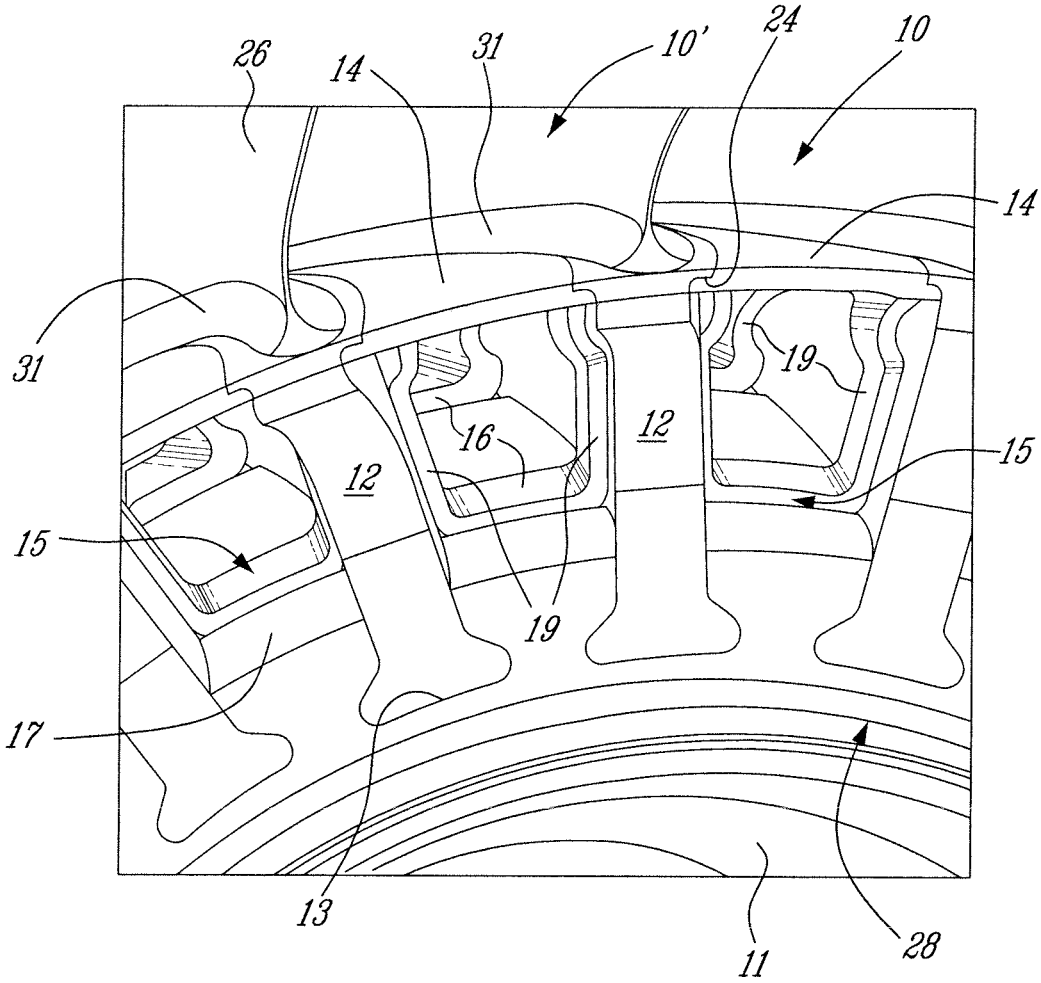
FIG. 2 is a fragmented front perspective view showing details of the fan blade connection portion to the fan hub.
Figure 3:
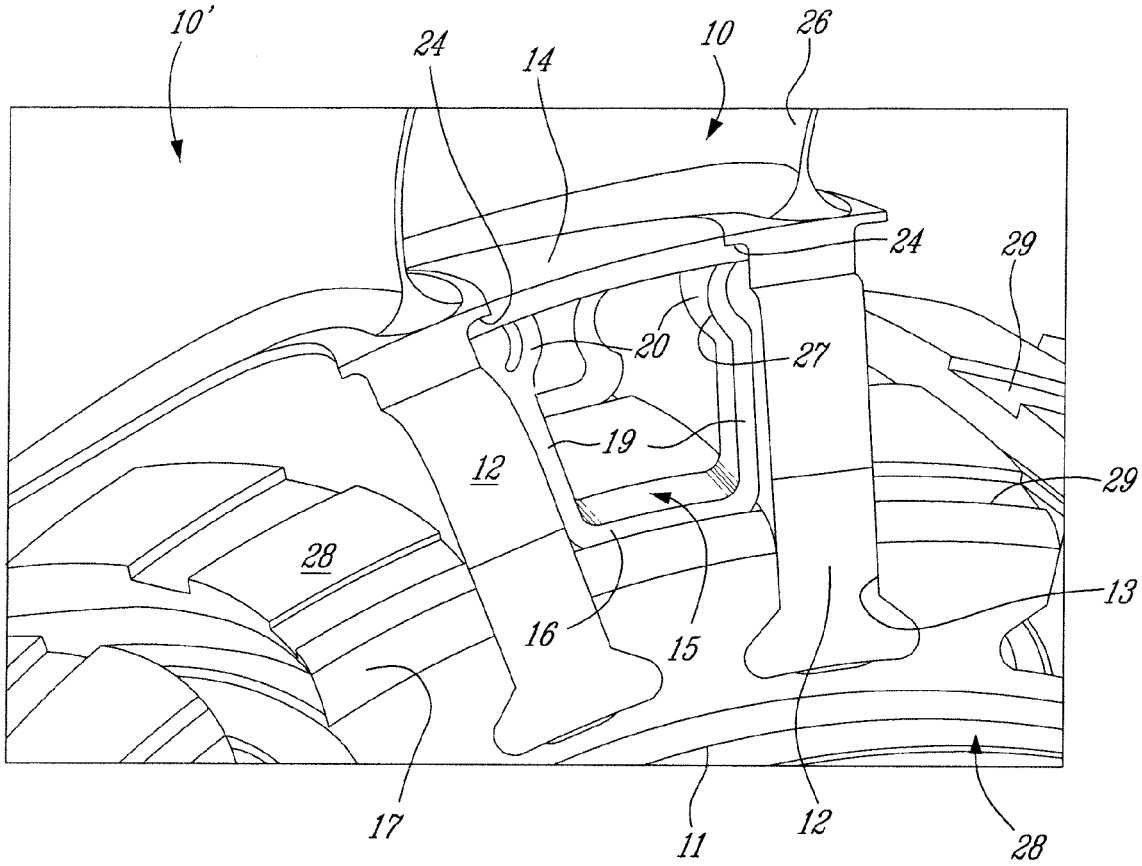
FIG. 3 is an enlarged view of a portion of FIG. 2.
Figure 4:
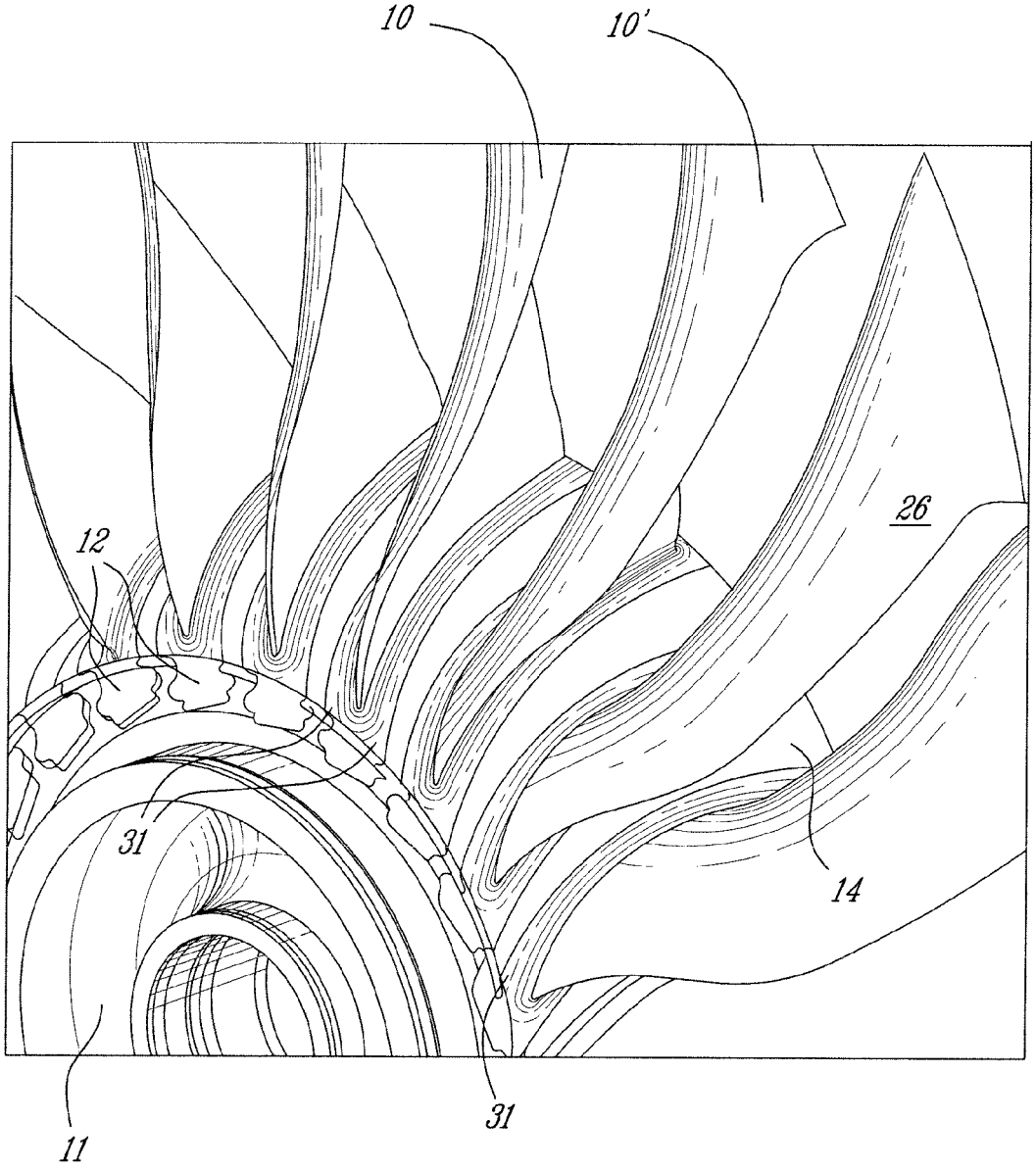
FIG. 4 is a rear perspective view or the fan hub illustrating the anti-fretting blade platform inserts interposed between the fan blades.
Figure 5:
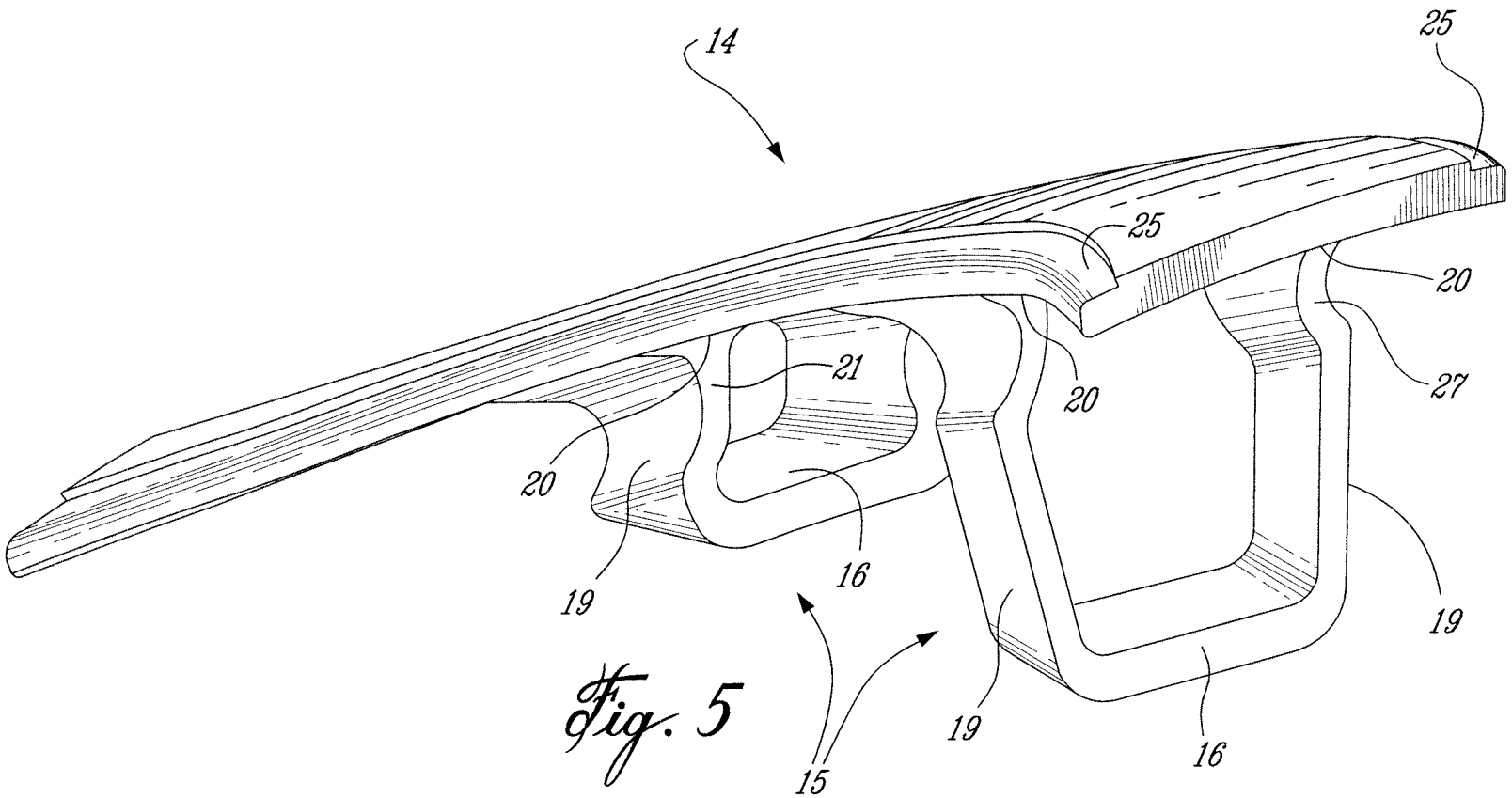
FIG. 5 is an isometric view of one anti-fretting blade platform insert.

With reference now to FIGS. 2, 3 and 5, the fan blade anti-fretting structure 15 is herein shown and comprises a pair of U-shaped legs formed of composite spring material, such as carbon fiber epoxy or other material capable of having a memory, whereby to retain its shape when flexed. The spring-loaded legs of the anti-fretting structure 15 can be interconnected by the blade platform insert 14 (see FIG. 5). The anti-fretting legs each define a bottom wall portion 16 which is configured to abut an outer or rim surface portion 17 of the rotor fan hub 11 between adjacent fan blades 10 and 10', as shown. The anti-fretting legs also each define opposed side wall portions 19 formed integral with the bottom wall portion 16. Each U-shaped leg has outer flat abutment surfaces spring-loaded against the opposed inwardly facing sides of the root sections 12 of adjacent fan blades outside of the associated slots 13. The side wall portions 19 are dimensioned to abut at an upper end 20 thereof against a connection of opposed fan blades. As herein shown, the connection can be constituted by the blade platform insert 14 spanning the gap between adjacent reduced blade platforms. The anti-fretting structure 15 is dimensioned and configured to push the platform insert 14 against and undersurface of the blade platforms 31 to thereby exert a pulling force on the root portions 12 of the adjacent fan blades 10 and 10' to prevent rocking of the root portions in their respective root slots 13. Because the root portions are loosely fitted within the root slots 13 as they are axially slid therein, this radial pulling force exerts a constant restraining force on the root portions within their respective root slots and prevent rocking of the fan blades at low rotational speeds such as cause by wind milling when the engine is off.

As mentioned herein above, the connection to the adjacent fan blades can be accomplished by the platform insert 14 which is held in the gap between adjacent fan blade platforms 31 by arresting formations 24 formed integral with the blades 10 in the reduced blade platform area at the transition between the airfoil section 26 of the fan blade 10 and the root portion 12. The anti-fretting or biasing structure 15 is dimensioned such as to push the platform insert 14 against the arresting formations 24 in contact with the opposed fan blades.

As herein shown the opposed side wall portions 19 of the U-shaped legs have an inner curve spring action formation 27 in a top portion thereof. The bottom wall portion 16 as well as the side wall portions 19 also have flat outer side abutment surfaces and are shaped for close fit against the inner side walls of the root portion 12 of the fan blades and the rim 28 of the rotor fan hub 11. As shown in FIG. 3, the rotor fan hub 11 is provided with a pair of outwardly radially facing grooves 29 there around and the insert bottom wall portion 16 of each leg is provided in snap fit retention therein.

It is also pointed out that the spring action formation 27 may also be an engaging formation integrally formed with the side wall portions 19 for clapping engagement with an attaching formation (not shown) formed in the opposed side wall of the fan blade root portion 12 whereby to snap fit engage thereon. These biasing legs are installed from the downstream side of the rotor fan hub 11 and forcingly positioned between the hub peripheral wall or rim 28 and the blade platforms 31 whereby to be retained in tension to bias the platform insert 14 radially outwardly against the arresting formations 24 provided on the undersurface the reduced blade platforms 31.

The inner fan blade platform insert 14 can be formed as a flat metal plate which is shaped and dimensioned to span the gap formed between adjacent fan blade platforms 31 of the turbo fan engine A. The platform metal plate can be formed of the same material as the fan blades, usually titanium. The U-shaped legs of the anti-fretting 15 can be integrally joined to the underside of the platform insert 14. As above described, it is retained engaged under arresting formations 24 which can be provided in the form of lips or shoulders extending outwardly from opposed sides of the blade reduced size platforms 31. These lip formations 24 have a flat under face shaped to receive opposed edge face portion of the platform insert 14. As shown in FIG. 5, the platform insert 14 is provided along opposed sides thereof with shoulders 25 for engagement with the lip formations 24 on the undersurface of the blade platforms 31. The top surface of the platform insert 14 is leveled with the blade platform top surface when the shoulders 25 are pushed against the lip formations 24, thereby providing a smooth composite platform surface between the blades. The platform inserts 14 can be provided with a slight arcuate profile as herein shown to cooperate with the reduced blade platforms 31 in forming a smooth inner boundary flow path for the incoming air.

Accordingly, the platform design as herein describe result in a light weight platform which fill the gap between the fan blades reducing the size of the fan blade platform usually formed integrally with the fan blades and consequently reducing the weight and cost of the fan blades. This also results in less containment/weight needed in the fan case. Further, the anti-fretting structures 15 cooperate with the platform inserts 14 to provide a radially outward biasing force between the rim 28 of the fan hub 11 and the blade platforms 31, thereby resisting movement between the fan blade root and the root slot 13 formed in the rotor fan hub 11 substantially eliminating wear between these elements when the fan blades 10 are turned at low speeds. Accordingly, in the assembly of the fan blades on the rotor fan hub the blade root are easily inserted into the root slots and are later biased in tension by the insertion of the anti-fretting and platform inserts thus eliminating movement between the blade root in the root slot when the fan is turned by wind action with the engine off.

The fan blade anti-fretting insert actively contributes preventing wear between a root portion of a fan blade and a root slot of a rotor fan hub of a turbo fan engine. This can be accomplished by providing an insert member formed of composite spring material having a memory. The insert is positioned in the gap formed between the root portions of adjacent fan blades and abuts at an outer surface portion of the rotor fan hub in the gap and at an upper end thereof abuts a connection formed in opposed fan blades. The insert thus applies a pushing force against the connection engaged by the opposed wall portions to result in a pulling force on the root portion to prevent rocking of the root portion in the root slot at low rotational speeds of the rotor fan hub such as caused by wind milling of the fan blades. The insert member can be formed of spring steel material and can be forced in a gap to locate a bottom wall portion thereof in a radial groove formed in the outer surface portion of the root fan hub for retention of the insert member at a precise location in the gap.

The above description is meant to be exemplary only, and one skilled in the art will recognize that changes may be made to the embodiment described therein without departing from the scope of the invention disclosed. For instance, it is understood that the anti-fretting device could take various forms and is not limited to a pair of interconnected U-shaped legs. It is therefore within the ambit of present invention to cover any obvious modifications provided that these modifications fall within the scope of the appended claims.

What is claimed is:

1. A fan blade anti-fretting arrangement to prevent wear between a root portion of a fan blade and a root slot of a rotor fan hub of a turbo fan engine, the anti-fretting arrangement comprising a U-shaped insert member formed of a composite spring material having a memory, said insert member defining a bottom wall portion abutting an outer surface portion of the rotor fan hub between adjacent fan blades and opposed side wall portions formed integral with said bottom wall portion, said side wall portions being dimensioned to push at an upper end thereof against a platform connection of the adjacent fan blades, said insert member being dimensioned to exert a pushing force against the connection platform of the adjacent fan blades and a pulling force on the root portion to prevent rocking of the root portion in the root slot at low rotational speeds.

2. The fan blade anti-fretting arrangement as claimed in claim 1, wherein the platform connection of the adjacent fan blades comprises a platform insert held between the adjacent fan blades, said platform connection being a surface force applied against the platform insert in abutment with the adjacent fan blades.

3. The fan blade anti-fretting arrangement as claimed in claim 2, wherein said opposed side wall portions have an inner curved spring action formation in a top portion thereof.

4. The fan blade anti-fretting arrangement as claimed in claim 2, wherein said opposed side wall portions each have an engaging formation integrally formed therewith for clamping engagement with an attaching formation formed in said root portion of said fan blades below said platform insert.

5. The fan blade anti-fretting arrangement as claimed in claim 1, wherein said composite spring material is a carbon fiber epoxy material.

6. The fan blade anti-fretting arrangement as claimed in claim 1, wherein said bottom wall and side wall portions have flat outer abutment surfaces.

7. The fan blade anti-fretting arrangement as claimed in claim 1, wherein said bottom wall portion is sized for close fit engagement in a radial groove formed in said outer surface of said rotor fan hub.

* * * * *